US008099989B2

(12) United States Patent
Bradley et al.

(10) Patent No.: US 8,099,989 B2
(45) Date of Patent: Jan. 24, 2012

(54) ELECTROMAGNETIC SHAPE CALIBRATION OF TUBES

(75) Inventors: John R. Bradley, Clarkston, MI (US); Michael H. Lovell, Leonard, MI (US); Kevin R. Marks, Durand, MI (US); Terry A. Kent, East China, MI (US); Donald W Cotton, Royal Oak, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 393 days.

(21) Appl. No.: 12/434,703

(22) Filed: May 4, 2009

(65) Prior Publication Data

US 2010/0024503 A1 Feb. 4, 2010

Related U.S. Application Data

(60) Provisional application No. 61/085,057, filed on Jul. 31, 2008.

(51) Int. Cl.
*B21D 39/00* (2006.01)
*B23P 17/00* (2006.01)

(52) U.S. Cl. ..... 72/56; 72/58; 72/61; 72/62; 72/430; 29/419.2

(58) Field of Classification Search ..... 72/54, 56, 72/58, 60, 61, 62, 430; 29/419.2
See application file for complete search history.

(56) References Cited

U.S. PATENT DOCUMENTS

| | | | | | |
|---|---|---|---|---|---|
| 4,437,326 | A * | 3/1984 | Carlson | 72/62 |
| RE33,990 | E * | 7/1992 | Cudini | 72/370.22 |
| 5,353,617 | A * | 10/1994 | Cherian et al. | 72/56 |
| 5,634,364 | A * | 6/1997 | Gardner et al. | 72/56 |
| 5,776,270 | A * | 7/1998 | Biondich | 72/56 |
| 5,826,320 | A * | 10/1998 | Rathke et al. | 29/419.2 |
| 6,272,894 | B1 * | 8/2001 | Hudson et al. | 72/61 |
| 6,751,994 | B2 * | 6/2004 | Horton et al. | 72/55 |
| 6,968,718 | B2 * | 11/2005 | Imamura | 72/56 |
| 7,487,655 | B2 * | 2/2009 | Imamura et al. | 72/56 |

* cited by examiner

*Primary Examiner* — David Jones
(74) *Attorney, Agent, or Firm* — Reising Ethington P.C.

(57) ABSTRACT

Articles are often formed from a tubular workpiece in a process which does not usefully shape the ends of the tube. In an embodiment of the invention, tube ends may be mechanically reduced in cross section and then expanded against a secondary forming surface(s) using an electromagnetic force to obtain desired shapes for the tube ends and minimize scrapping of workpiece material.

14 Claims, 5 Drawing Sheets

ELECTROMAGNETIC SHAPE CALIBRATION OF TUBES

This application claims the benefit of U.S. Provisional Application No. 61/085,057, titled "Electromagnetic Shape Calibration of Hydroformed Tubes", and filed Jul. 31, 2008.

TECHNICAL FIELD

This invention relates to forming metal tubes into articles of predetermined length-wise shape and cross-sectional configurations. In particular, the invention pertains to a method of reshaping the tube ends as part of the manufactured article rather than discarding these portions of the tube as scrap metal.

BACKGROUND OF THE INVENTION

Automotive vehicle body structural members and other articles of manufacture may be made by bending (if necessary) and expanding at least portions of a metal tube against one or more restraining and shaping dies. An example of such a structural member is a body frame rail. When metal tubes are formed into desired articles, a length of tubing at each end may have an irregular shape and therefore may be discarded as scrap metal. It would be desirable to reshape the tube ends as part of the article to reduce wasted metal.

One example of a forming process for metal tubes is hydroforming. Conventional tube hydroforming requires that the ends of the metal tube workpiece be attached and sealed to an apparatus that fills the tube with highly pressurized fluid needed to expand the tube to fill a die cavity. The tube is filled with water or other fluid, and water pressure or other fluid pressure is applied to the inside of the tube to expand it against forming surfaces of a shaping die or mold. The tube may be straight or bent to achieve a desired shape such as that of a vehicle body rail.

Thus, a length of tubing at each end of the part used for this attachment cannot normally be shaped by the die or become part of the finished hydroformed part. There is also typically a length of tube described as a transition zone, further away from and not directly attached to the pressurization apparatus, which is also partially constrained from being fully formed into the die cavity to the finished part shape. After hydroforming the tube, the combined length of material comprising the transition zone and attachment length, which in some cases is about 300 mm long, are removed from the as-formed tube as engineered scrap. In the manufacture of a substantial number of hydroformed parts considerable tube metal must be removed and discarded. After the length of material comprising the transition zone and attachment length is removed, the hydroformed part may be subjected to secondary post-forming operations such as trimming the edge of the part, piercing holes in the part, or the like.

There is a need to utilize such end portions of metal tubes in the formed part instead of removing and discarding them.

SUMMARY OF THE INVENTION

This invention provides a secondary forming operation whereby mechanical and/or electromagnetic forces are used to reshape the transition zone and attachment portions of one or both ends of a tube to finished part shape and dimensions and thus eliminate the engineered scrap at one or both ends of the tubular part. The cross section of the original tube and of the finished part may be of any suitable shapes. Although various embodiments may be described in the context of a tube used in hydroforming, the methods of the invention may applied to any suitable tube.

In one embodiment, the cross section of the original tube may be circular where attachment is made to a fluid pressurization apparatus, whereas the cross section of the finished part may be roughly rectangular or some other non-round shape. Prior to this invention, the initial tube workpiece had to include a length for the formed part plus additional length allowances for the transition zones and attachment portions at one or both ends of the tube. These portions for transition zones and attachment zones were later removed and discarded as scrap from the formed part.

In this invention, a length of the as-formed tube which includes both at least one attachment portion of the tube and the partially formed transition zone is used in the end of the formed part. One or both ends of the formed body are placed in a secondary forming die which defines the cross-sectional shapes and dimensions of the end portions of the finished part. In one embodiment, in the mechanical forming step this die is closed upon the tube end to compress it into an intermediate shape. This mechanical forming step may be useful to roughly pre-shape the tube end such that in a subsequent step of the process a suitable electromagnetic forming pressure may be exerted in a radially outward direction, i.e., to expand rather than to compress the tube in order to force the outer surface of the tube into conformance with shaping surfaces of the secondary die cavity. In another embodiment, the geometry of the desired tubular product may be such that the mechanical forming step is not needed.

Thus, end portions of a formed tube article are mechanically and/or electromagnetically reshaped into the configuration of a desired tubular product. Little or no material need be removed from the ends of the formed article. In another embodiment, a mandrel may be positioned inside the tube end and the mechanical forming step may include pressing a tube end against the mandrel to manage the decrease of a dimension of the cross section of the tube end. In another embodiment, the mandrel may include a rigid outer layer enclosing an electromagnetic forming coil. After the mechanical reshaping step, the rigid outer layer may be retracted to expose the forming coil for use in the subsequent expanding step.

In various embodiments, the secondary forming tool may also include a trimming edge to achieve a desired trimmed tube edge of the shaped article, for example but not limited to a notched tube edge. The secondary forming surface may also include discrete piercing features for piercing or punching the tube end when the electromagnetic force is used to expand the tube end against the secondary forming surface.

This method of reshaping the ends of formed tube workpieces may be applied to tubular materials that are responsive to a momentary, powerful electromagnetic field to expand the affected portion of the tube material into configuration with a reshaping die. Thus, the method is readily applicable to metal alloys, such as aluminum alloys, having suitable electrical conductivity and responsiveness to the expanding field of a suitably shaped electromagnetic coil inserted within the tube end and its constraining forming die.

Other objects and advantages of the invention will be apparent from the following descriptions of embodiments of the practice of the invention.

DESCRIPTION OF PREFERRED EMBODIMENTS

This invention is applicable in shaping formed tubular workpieces. In general, the tubes are metallic. The tubes may be made of, for example but not limited to, suitable aluminum alloys, steel, or magnesium alloys. The initial tube may have any suitable thickness and length. The initial tube may have a length selected for the length of the part to be formed and a wall thickness dictated by the strength requirement of the part. In one embodiment, the tube may have a thickness of about three to about five millimeters. In another embodiment, the tube may have a thickness of about one millimeter. In applications for automotive vehicle structural body parts, for example, the tube may be aluminum alloy with a thickness of about three to about five millimeters and a length of several feet. Another application for automotive structural components, for example, may use substantially thinner tube materials having a thickness on the order of a millimeter.

When the tubular workpiece is to be shaped by hydroforming, water or other fluid is injected into the tube, filling it and subjecting the circumferential wall to fluid pressure to expand at least portions of the outer wall surface against the forming surfaces of a forming tool (die) encircling the tube. In order to introduce, confine, and pressurize the fluid within the tube, the ends of the workpiece are secured in or by the hydroforming apparatus. As stated, some portion of each end of the tubular workpiece is encumbered by the apparatus and inaccessible during the hydroforming process for forming into the intended shape of a desired article. An object of this invention is to provide a method for reshaping one or both ends of a formed tube to the shape of a specified article.

Figure 1:
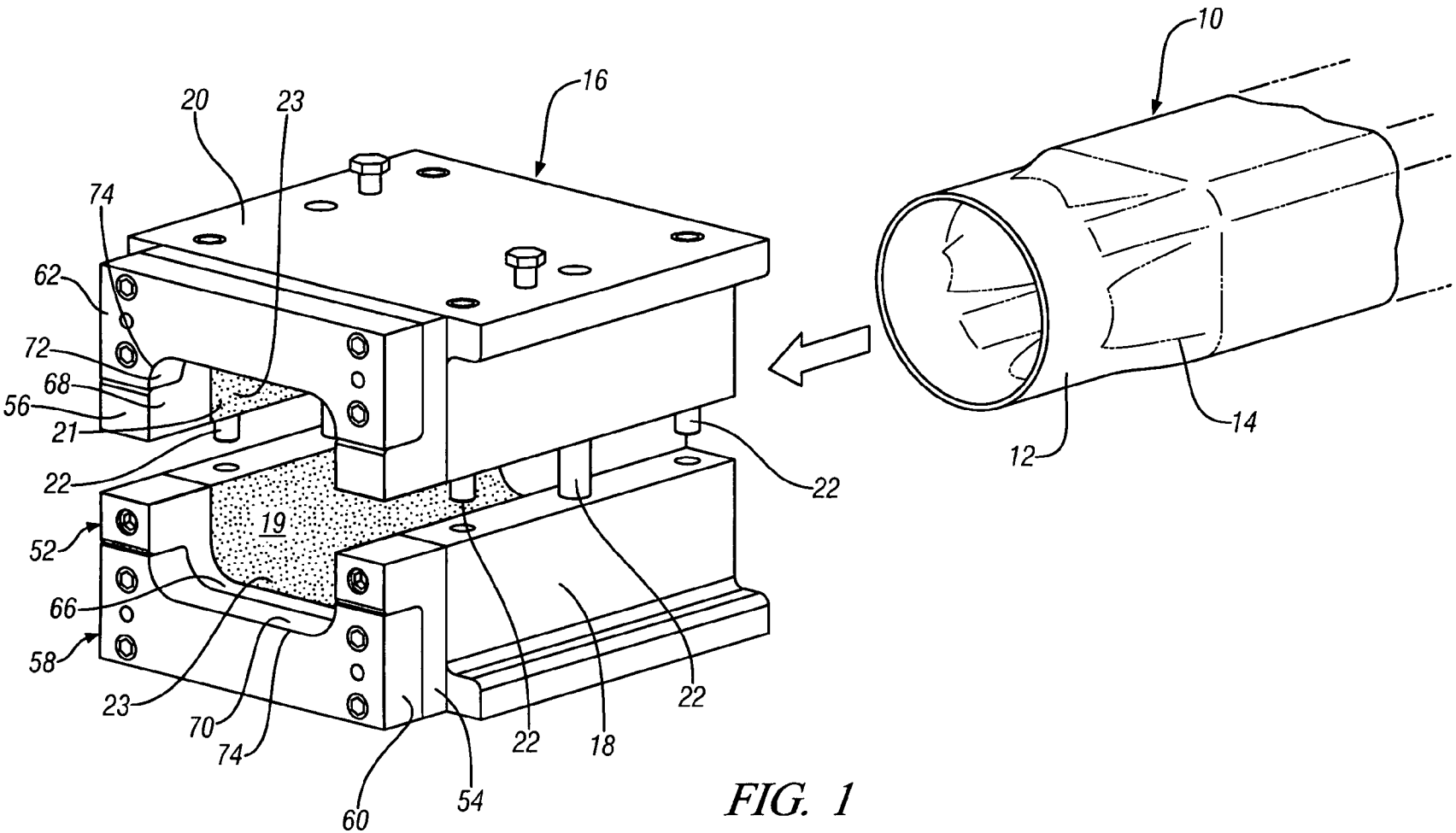
FIG. 1 is a schematic illustration of the shape of one of two generally round ends of a formed tube for placement in an opened reshape tool to commence reshaping of the tube end into an intermediate shape for further reshaping into a desired article shape.

In FIG. 1 a broken-off end portion only of a formed tubular product 10 is illustrated for reshaping in accordance with an embodiment of this invention. Tubular product 10 may, for example, be a body frame rail for an automotive vehicle. Such a body frame member may be several feet long and formed from an aluminum tube of suitable internal diameter and wall thickness. The principal intermediate portion of the formed product has cross-sectional configurations along its length as required by the product design. These configurations are formed by expanding the tube workpiece against one of more die members. Two such formed body members may be used in a vehicle and they may be connected with cross-members. These details are not illustrated in this specification because the focus of this invention is on reshaping of the ends of the formed product to shapes required for the body member in a body structure.

As illustrated in FIG. 1, formed article 10 has an end portion (or attachment portion) 12 that has the cross-sectional shape required by or imposed by the forming apparatus. The cross-sectional shape of the attachment portion 12 may be circular. Article 10 also has a transitional portion 14 that may acquire a shape because of its location between the portion of the tube workpiece gripped in a forming apparatus and a nearby forming die for the article. The total length of tube product end portions 12 and 14 may be determined by the attachment requirements of the forming apparatus and the location of an adjacent forming tool or tools. For example, in one embodiment the total length of the tube product end portions 12 and 14 may be about 200 to 300 millimeters. In other embodiments, the total length of the tube product end portions 12 and 14 may be any length. In many instances at least a portion of the end of the tube may be round and at least a portion of its cross-section may have a larger dimension than a specified cross sectional dimension of a desired product. Accordingly, a process is employed to reshape the tube end portions 12, 14 of one or both ends of the tube into a shape required for the product of which it is now a part.

An open-ended, box-like reshaping tool 16 is provided of a length and cross-sectional shape to reform the end portion of the formed tube workpiece. The reshape tool 16 may be split longitudinally about a horizontal plane so as to provide a lower forming tool portion 18 and a complementary upper forming tool portion 20. Lower forming tool portion 18 has a forming surface 19 and upper forming tool portion 20 has a complementary forming surface 21. In FIG. 1, lower 18 and upper 20 reshaping tool portions are shown in a spaced-apart, open position to receive end portions 12 and 14 of a formed tubular workpiece 10. As stated, the tubular workpiece may be quite long but only the ends of the article such as end portions 12 and 14 are normally involved in the practices of this invention.

According to one embodiment, in a first step, end portions 12, 14 of tube workpiece 10 are placed between members 18, 20 of the opened reshaping tool 16 and the tool is closed by a suitable actuator (not shown) to mechanically squeeze or press the tube end to reduce a dimension of its cross-section to make it smaller than, or equal to, the corresponding portions of the specified product. One or more guide rods 22 may be used to maintain alignment of lower 18 and upper 20 reshaping tool portions as they are closed against tube end portions 12, 14 to compress the end portions 12, 14 into an intermediate shape.

In the following specification, the reshape forming tool (for example tool 16 in FIG. 1) is sometimes referred to as a secondary forming tool or die to distinguish it from the primary forming die (or dies) used to shape the intermediate portions of the tube length to the shape of the specified article. In general, the internal forming surfaces 19, 21 of the secondary die 16 are prepared to form the desired final tube-end shape(s) of the article at its forming stage of manufacture.

Figure 2:
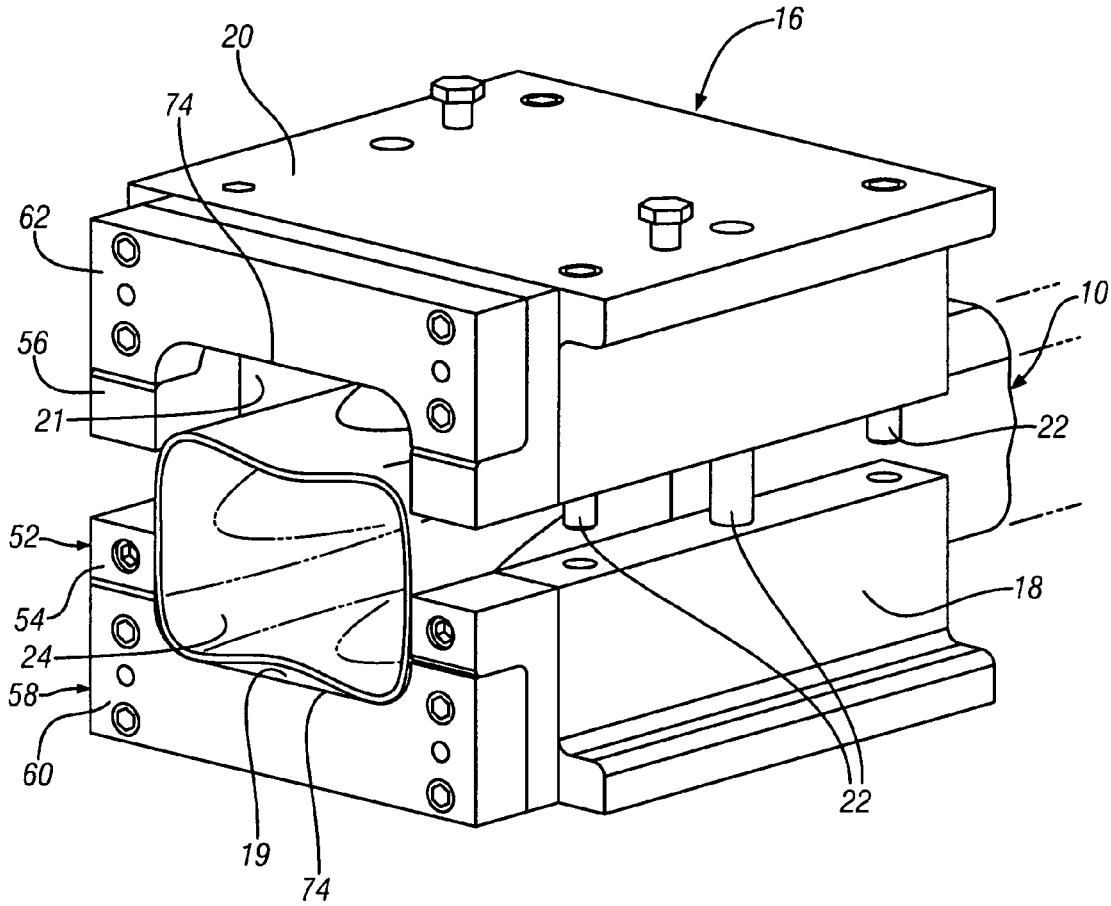
FIG. 2 illustrates an end of a formed tube in a reshaping tool after the tube end has been mechanically formed in the tool to an intermediate shape.
Figure 3:
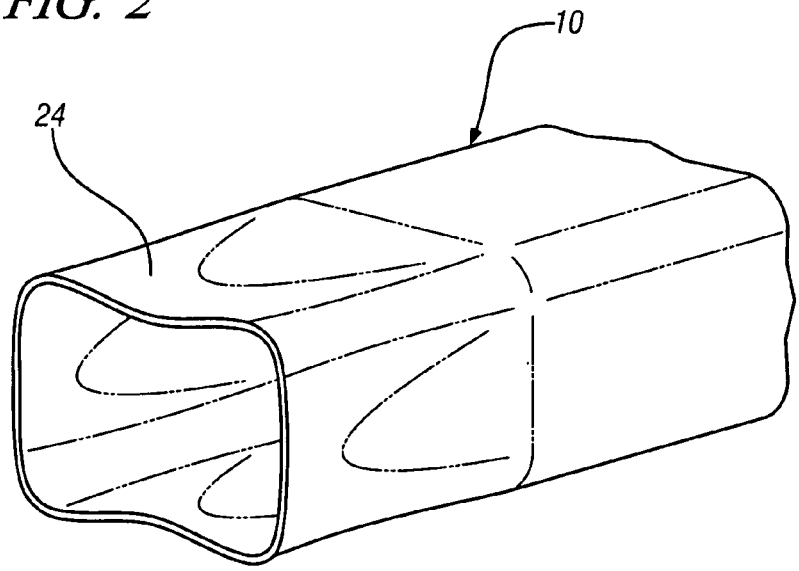
FIG. 3 illustrates the intermediate shape of the tube end.

In FIG. 2 the end portion 12 and transitional portion 14 of formed article 10 have been mechanically squeezed and shaped to an intermediate shape. The round end portion 12 and tapered transitional portion 14 have been mechanically reshaped into an intermediate tube end 24, which may have an irregular shape, for example that of a squashed hour-glass or peanut. This intermediate tube end 24 does not yet wholly conform to forming surfaces 19, 21. FIG. 3 shows the intermediate tube end 24 in a removed position. In many embodiments of the invention, however, the intermediate tube end 24 may be left in the original reshape tool for subsequent, second step reshaping.

According to one embodiment, in a second step, the reduced cross-section of intermediate tube end 24 is then expanded against forming surfaces 19, 21 of the reshape tool 16, or against another forming tool surface, using an electromagnetic forming force to acquire a desired part configuration.

Figure 4:
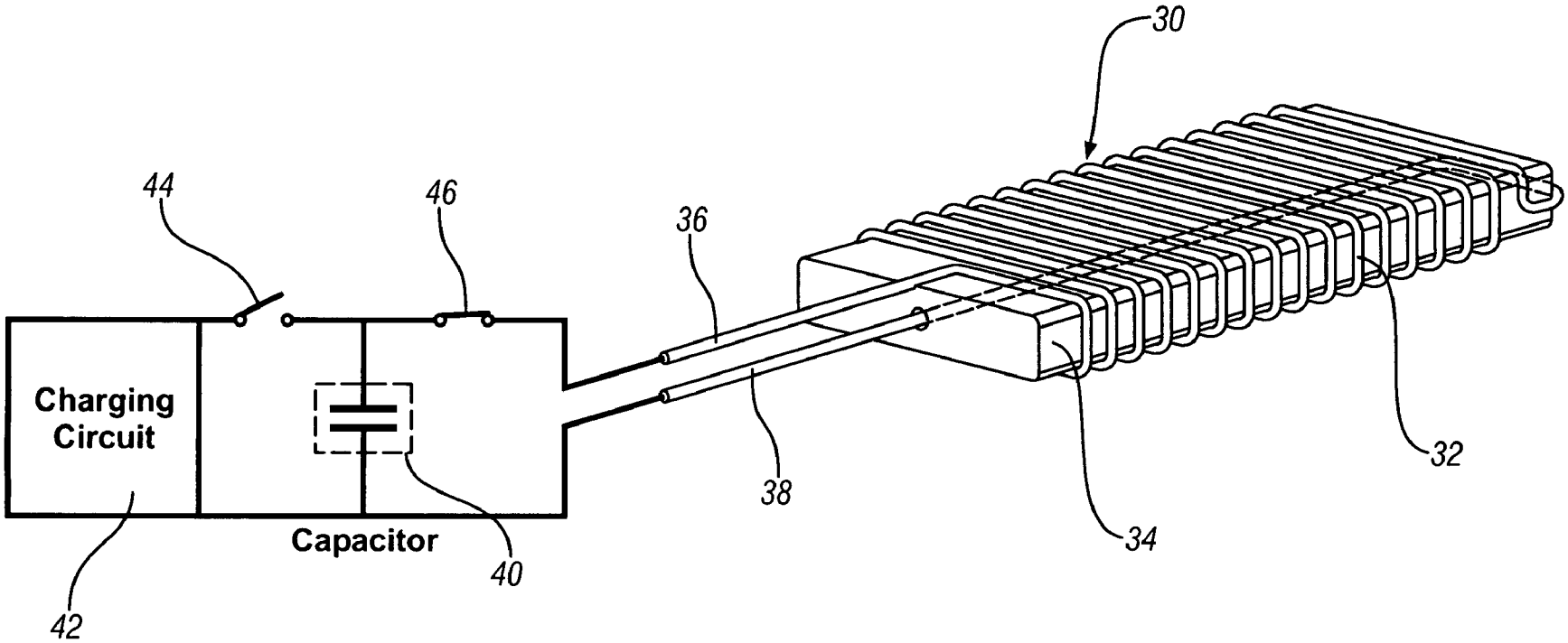
FIG. 4 illustrates a charging circuit for an electromagnetic forming tool. The electromagnetic forming tool is shaped to fit inside the end of the tube in its intermediate shape.
Figure 5:
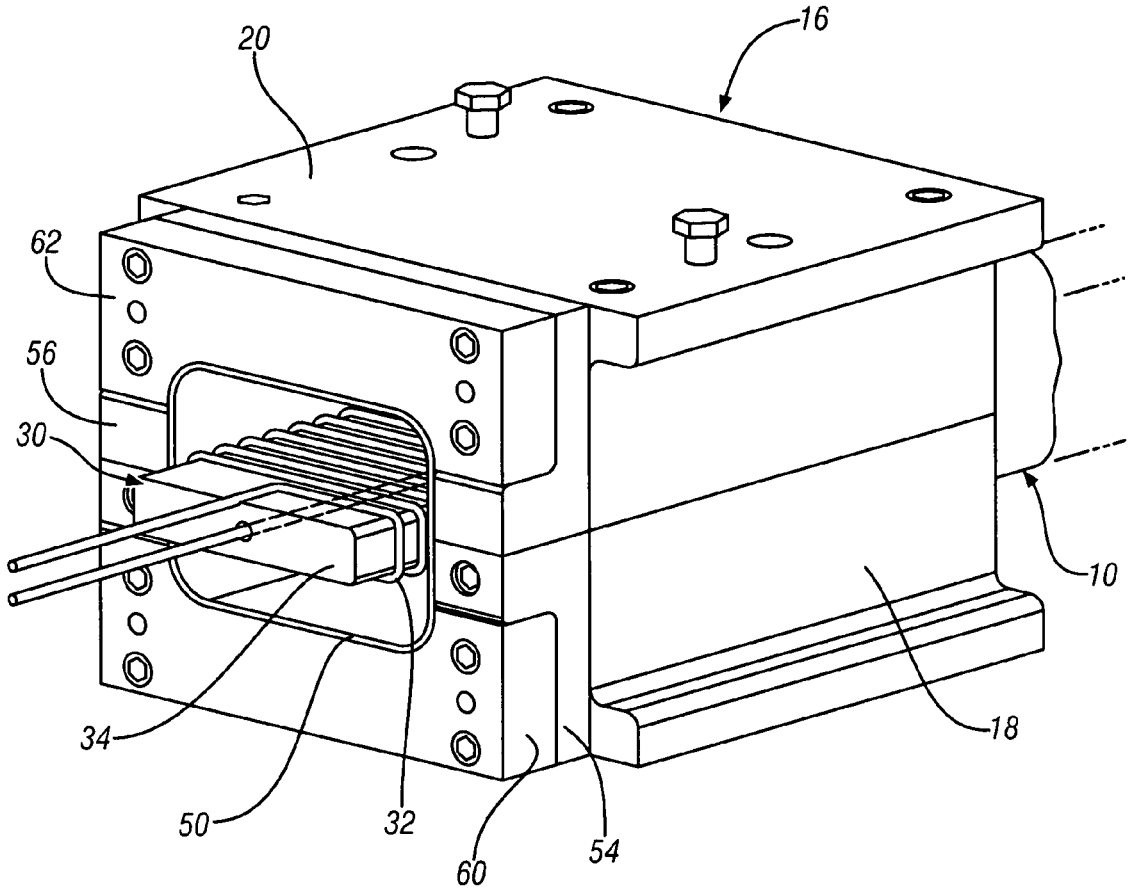
FIG. 5 illustrates the placement of the electromagnetic forming tool into the end of the tube which has been placed in the reshaping tool. When the electromagnetic forming tool is momentarily activated with a suitable electrical current, the tube end is expanded against the shaping surface of the reshaping tool to reform the tube end into a useful product shape.
Figure 6:
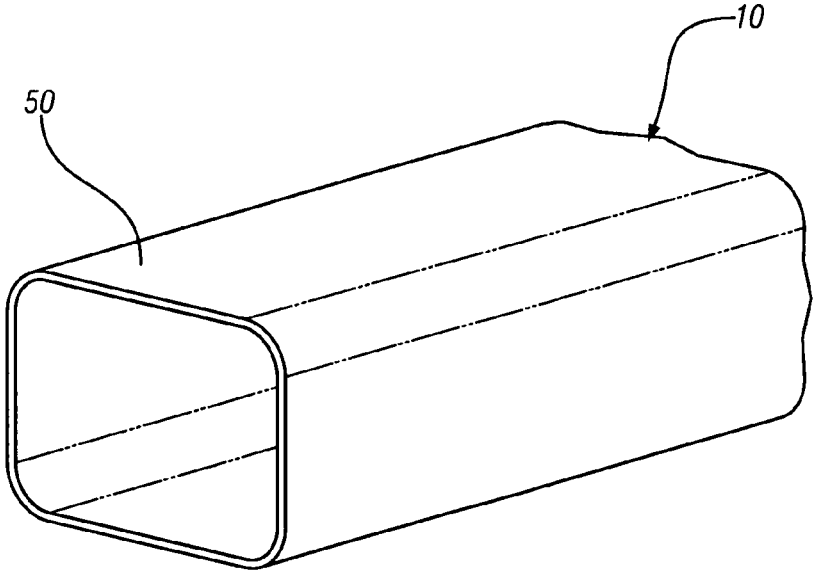
FIG. 6 illustrates the reshaped end of the formed tube in its product shape.

An electromagnetic forming force tool 30 and schematic charging circuit are illustrated in FIG. 4. The electromagnetic forming force tool 30 may comprise an electromagnetic forming coil of wire 32 formed on a high resistivity shaping block 34 shaped for insertion into the intermediate shape tube end. The coil of wire 32 may be a low resistivity coil. The coil of wire 32 may include any suitable material, for example but not limited to copper or copper-based alloys. The ends 36, 38 of coil 32 are connected to a suitable capacitor 40 which, in turn, is connected to a charging circuit 42. The charging circuit 42 charges the capacitor 40 when the coil 32 is not connected to the capacitor 40 using switches 44, 46 illustrated in the drawing. The capacitor 40 is then disconnected from the charging circuit 42. After the electromagnetic forming tool 30 is inserted into the intermediate tube end 24 in its reshape die 16 (FIG. 5), the capacitor 40 is discharged through the coil 32 to exert a momentary expansion force against the tube end to expand it to its desired product shape (tube end shape 50 in FIGS. 5 and 6). One or more charges and discharges of the electromagnetic forming tool may be employed in the shaping of the tube end. A typical current pulse may be in the range of about 100-200 kiloamps (kA) with duration in the range of about 10-20 microseconds (μs). In other embodiments, the current pulse may be in the range of about 100-2000 kA.

One embodiment of the invention is a two-step process where the inner surface of the secondary die is first used to partially collapse the tube, as described above, without the aid of an inner mandrel to support and restrict the motion of the tube. Thus, in the first step of this process, the tube end portions 12, 14 of the formed tube may take on only roughly the cross sectional shape of the finished part, e.g., approximately rectangular. However, since the collapse of the tube is unsupported, the shape of the intermediate tube end 24 after this first step may be substantially irregular and with inside dimensions significantly smaller than those of the finished part. In practice it has been observed that the circular end of a 4 mm thick wall aluminum alloy tube may take on a roughly hour glass or peanut-shaped cross section during this pre-shaping step.

In one embodiment, the second step of the process may be an electromagnetic reshaping operation. A purpose-designed electromagnetic forming coil is introduced into the end of the tube. The coil is attached to a highly energized capacitor bank. The capacitor bank is discharged to produce a pulse of very high electrical current and very short duration in the coil. This primary current pulse results in a very strong transient magnetic field surrounding the coil which, in turn, induces a secondary current in the tube. The magnetic field associated with the induced current in the tube is of opposite polarity to that of the coil. The result is a very strong magnetic pressure exerted on the tube forcing it to deform outward, i.e., away from the coil, ultimately contacting and conforming to the surface of the reshaping die. The tube-end section is often now accurately reshaped to the finished part dimensions, thus eliminating the otherwise scrapped portion of the tube. It may be possible to fully reshape the tube with a single pulse. Or it may be necessary to use multiple pulses depending on the material strength, thickness, configuration, and so forth.

In electromagnetic forming it sometimes happens that the workpiece impacts a forming surface at such a high velocity that it bounces off to a small degree rather than taking on the exact shape of the forming surface, which may be known as the bounce back or rebound effect. In such an event, the forming surfaces, for example forming surfaces 19, 21 may be prepared with a textured surface 23, as shown in FIG. 1. Such a forming surface texture is used to cause a small amount of additional plastic deformation on the surface of the tube as it impacts the die surface to minimize or prevent the bounce back effect. The textured surface may be any suitable surface that would result in appreciable surface plastic deformation. The textured surface may be, for example but not limited to, a knurled surface with a pattern of shallow features; a surface with an array of dimples, or ridges; or a roughened surface, for example by coarse sand or bead blasting. The textured surface features may be of any suitable depth. In one embodiment, the depth of the textured surface features may be on the order of about 0.5 to about 1.0 mm.

In the second step, the coil may be necessarily tapered with a smaller leading dimension so as to allow access to an initially small opening in the collapsed tube. In this case the coil may be repeatedly pulsed and indexed further into the tube end until ultimately the dimensions of the trailing portion of the coil establish the final shape with the last of the series of forming pulses.

In another embodiment, the tube end portions 12, 14 are again partially collapsed by the secondary die in the first step of the process. However, in this case there may be initially a removable mandrel inside the tube. The mandrel acts to control the collapse or compression of the tube so that the tube end portions 12, 14 take on a regular and reproducible shape that is more near net shape of the finished part. Once the mandrel has been removed, the subsequent electromagnetic reshaping step may be essentially the same as described above. This embodiment would likely permit the use of a simpler (i.e., not tapered) and more durable coil. This also may be a more efficient and versatile method since the coil could potentially be designed to displace the tube material over a relatively short distance before contacting the die surface.

In another embodiment, the tube end portions 12, 14 are again partially collapsed by the secondary die in the first step. However, in this embodiment the mandrel and coil may be a single component. In this case a suitable coil is surrounded by a strong, rigid, protective and durable outer layer. Together they function initially as a mandrel during the preliminary mechanical pre-shaping step. After partial collapse of the tube onto the mandrel, the outer mandrel layer may, optionally, be retracted like a sheath to expose the coil. With or without the protective cover, the coil then functions to reshape the tube against the die surface to the finished part dimensions in the second step as described above.

In another embodiment, the mechanical and electromagnetic reshaping processes described above are done in a coordinated concurrent manner. In this case there is no separate mandrel per se. Instead the coil with dimensions suitable for shaping the tube to its finished dimensions resides within the tube during the initial mechanical pre-shaping operation. The secondary die compresses the tube incrementally in steps. As the tube material approaches the effective working distance between itself and the coil, the coil is pulsed at appropriate times so as to prevent contact with the tube. In one embodiment, for example, the effective working distance may be about 0.5 mm to about 3 mm. In this manner the tube wall is sequentially compressed and expanded with each step until the final shape is attained.

In still another embodiment of the invention, the initial mechanical forming step may not be necessary and the end portions 12, 14 of the tube may be enlarged or reduced against one or more forming surfaces by the use of one or more electromagnetic forming tools and one or more electromagnetic forming steps.

In another embodiment, the process may also include simultaneously accomplishing what would otherwise be performed using secondary post-forming operations such as trimming the edge of the part to any desired profile, for example using laser trimming, piercing cut-out openings in the part, for example using die cutting, and/or the like. In other words, when the tube end portions 12, 14 make contact with the tooling at very high velocities imparted by the electromagnetic force, the tube end portions 12, 14 may concurrently be trimmed and/or pierced by discrete piercing features or shearing edges in the secondary tooling, as further described below. The portion of the tube end portions 12, 14 that is trimmed or sheared off may be of any length, for example but not limited to about 1 mm to about 20 mm.

Referring to FIG. 1, the tool 16 may have an inner trim 52 and an outer trim 58. The inner trim 52 and the outer trim 58 may be composed of any suitable material, for example but not limited to steel. Each of the trims 52, 58 may be removable elements.

Figure 8:
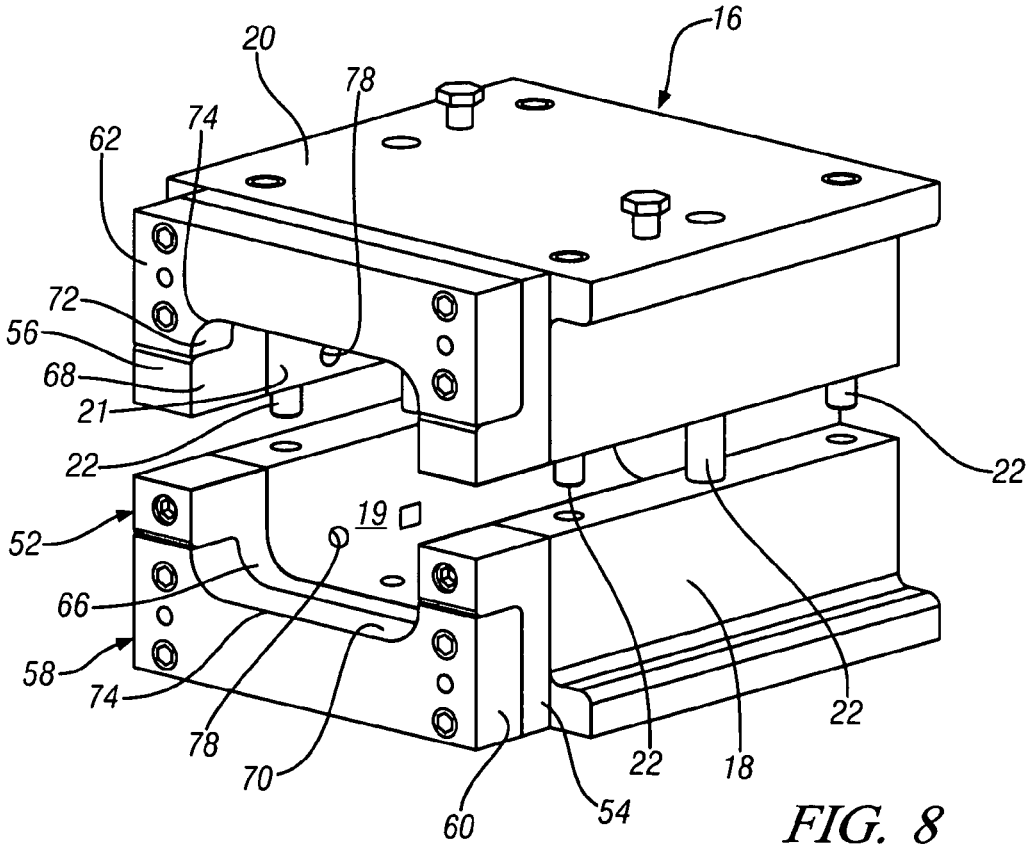
FIG. 8 illustrates an opened reshape tool in which forming surfaces of the tool have apertures comprising circular and square holes.

As shown in FIGS. 1, 2 and 8, the inner trim 52 comprises a first inner trim portion 54 mounted to the forming surface 19 of the lower forming tool portion 18, and a second inner trim portion 56 mounted to the forming surface 21 of the upper forming tool portion 20. The first inner trim portion 54 comprises a first inner trim portion surface 66 that faces the interior of the tool 16. The second inner trim portion 56 comprises a second inner trim portion surface 68 that faces the interior of the tool 16.

Referring to FIG. 1, the outer trim 58 comprises a first outer trim portion 60 mounted to the first inner trim portion 54, and a second outer trim portion 62 mounted to the second inner trim portion 56. The first outer trim portion 60 comprises a first outer trim portion surface 70 that faces the interior of the tool 16. The second outer trim portion 62 comprises a second outer trim portion surface 72 that faces the interior of the tool 16.

In one embodiment, the inner trim 52 and outer trim 58 are in place, as illustrated in FIG. 2, during the electromagnetic reshaping step. The edges of the trims 52 and 58 may form a straight end cutting edge 74 (shown in FIGS. 1, 2, and 8). High velocity impact of the tube material with this straight end cutting edge 74 during the electromagnetic forming step results in a shearing off or trimming of a portion of the tube end portions 12, 14, resulting in a straight edge on the tube end.

Figure 7:
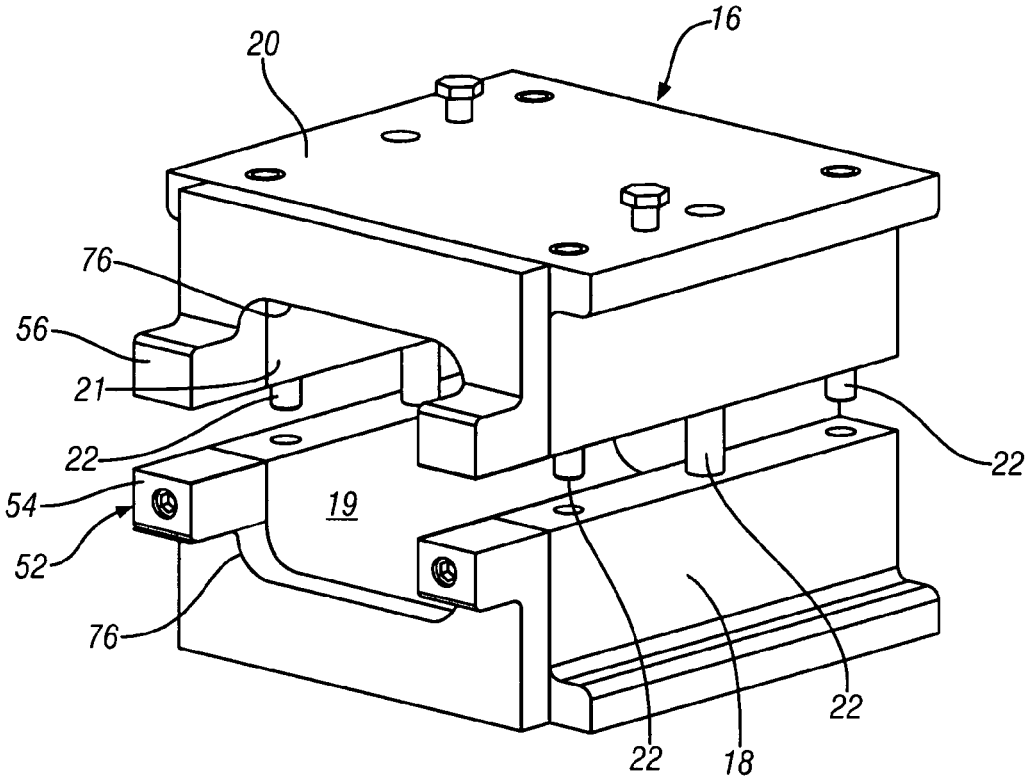
FIG. 7 illustrates an opened reshape tool with first and second outer trim portions removed.

In another embodiment, the first outer trim portion 60 and the second outer trim portion 62 may be removed, as illustrated in FIG. 7, prior to the electromagnetic reshaping step. By removing the outer part of the top and bottom removable elements, a cutting edge 76 is exposed having a geometry different than the straight end cutting edge 74. High velocity impact of the tube material with the cutting edge 76 during the electromagnetic forming step results in a shearing off or trimming of a portion of the tube end. The resulting trimmed tube end may have any suitable profile or geometry, for example but not limited to, a notched tube end, or a v-shaped notched tube end. The profile or geometry of the trimmed tube end is determined by the geometry of the cutting edge 76, which in turn is determined by the geometries of the first inner trim portion 54 and the second inner trim portion 56. The geometries of the first inner trim portion 54 and the second inner trim portion 56 may be the same, or they may be different.

In another embodiment a portion of at least one of the forming surface 19, the forming surface 21, the first inner trim portion surface 66, the second inner trim portion surface 68, the first outer trim portion surface 70, or the second outer trim portion surface 72 may include at least one discrete piercing or punching feature 78 for piercing or punching the tube. When the tube makes contact with the discrete piercing feature 78 at very high velocities imparted by the electromagnetic force, the tube may be pierced or punched in the desired cut-out shape. The discrete piercing feature 78 may have suitably sharp edges.

In one embodiment, the discrete piercing feature 78 may be an aperture, hole, or slit having any suitable shape. In one embodiment, the discrete piercing feature 78 may be holes of any suitable shape in at least one of the aforementioned surfaces 19, 21, 66, 68, 70, or 72. The holes may be, for example but not limited to, circular, triangular, or rectangular holes. Referring to FIG. 8, in one embodiment the discrete piercing features 78 in the forming surfaces 19, 21 may be circular and square holes.

In another embodiment, the discrete piercing feature 78 may be a body (not shown), either solid or hollow, that extends from at least one of the aforementioned surfaces 19, 21, 66, 68, 70, or 72, for example but not limited to a cone, pyramid, cylindrical pin, rod, spike, or stake. In one embodiment, the body may be constructed and arranged to retract into the surfaces 19, 21, 66, 68, 70, or 72 after the tube has been pierced or punched by the bodies.

The invention has been illustrated by some specific embodiments but the scope of the invention is not limited to these examples.

The invention claimed is:

1. A method of forming a metal tube workpiece into a shaped article, the metal tube workpiece having two tube ends where at least one tube end requires shaping to obtain the shaped article, the method comprising:

placing a mandrel inside the tube end, the mandrel comprising a rigid outer layer enclosing an electromagnetic forming coil;

mechanically reshaping the at least one tube end by pressing the one tube end against the mandrel, the mechanical reshaping comprising decreasing a dimension of the cross section of the one tube end to an intermediate cross section;

retracting the rigid outer layer to expose the coil; and using an electromagnetic force by discharging an electrical current through the coil to expand the one mechanically reshaped tube end against a forming surface to obtain the desired tube end shape of the shaped article.

2. A method of forming a metal tube workpiece as recited in claim 1 in which both ends of the tube workpiece are shaped by practices of the claimed method.

3. A method of forming a metal tube workpiece as recited in claim 1 in which mechanically reshaping the at least one tube end comprises placing the one tube end in a forming tool having the forming surface and pressing the one tube end against the mandrel using the forming surface.

4. A method of forming a metal tube workpiece as recited in claim 1 in which the forming surface comprises a textured surface to cause plastic deformation on the surface of the one tube end as the one tube end expands against the forming surface.

5. A method of forming a metal tube workpiece as recited in claim 1 in which the forming surface comprises at least one discrete piercing feature, and in which the expanding step further comprises expanding the one tube end against the discrete piercing feature to pierce or punch the one tube end.

6. A method of forming a metal tube workpiece as recited in claim 1 in which the expanding step comprises placing the one mechanically reshaped tube end in a forming tool having the forming surface and applying an electromagnetic force to expand the one tube end against the forming surface.

7. A method of forming a metal tube workpiece as recited in claim 1 in which the electromagnetic force is applied more than once by successive discharges of an electrical current through the coil.

8. A method of forming a metal tube workpiece as recited in claim 3 in which the forming tool comprises a trimming edge, and in which the expanding step further comprises expanding the one mechanically reshaped tube end tube end against the trimming edge to obtain a desired trimmed tube edge of the shaped article.

9. A method of forming a metal tube workpiece as recited in claim 8 in which the trimming edge is shaped to provide a notched trimmed tube edge of the shaped article.

10. A method of forming a metal tube workpiece into a shaped article, the metal tube workpiece having two ends where at least one end requires shaping to obtain the shaped article, the method comprising:

mechanically reshaping the at least one tube end, the mechanical reshaping comprising decreasing a dimension of the cross section of the one tube end to an intermediate cross section; and using an electromagnetic force to push the one tube end against one or more forming surfaces to obtain the desired tube end shape of the shaped article by inserting an electromagnetic forming coil within the one mechanically reshaped tube end and discharging an electrical current through the coil, the coil being tapered for progressive entry into the end of the reshaped tube end.

11. A method of forming a metal tube workpiece as recited in claim 10 in which the electromagnetic force is applied by inserting a first coil within the one mechanically reshaped tube end and discharging an electrical current through the coil and then inserting a second larger electromagnetic forming coil within the one tube end and discharging an electrical current through the second coil.

12. A method of forming a metal tube workpiece as recited in claim 10 in which the forming surface comprises a textured surface to cause plastic deformation on the surface of the one tube end as the one tube end expands against the forming surface.

13. A method of forming a metal tube workpiece as recited in claim 10 further comprising a forming tool comprising the one or more forming surfaces and comprising a trimming edge, and in which the one tube end is simultaneously pushed against the trimming edge to obtain a desired trimmed tube edge of the shaped article.

14. A method of forming a metal tube workpiece as recited in claim 10 in which the forming surface comprises at least one discrete piercing feature, and in which the expanding step further comprises expanding the one tube end against the discrete piercing feature to pierce or punch the one tube end.

* * * * *